US011428377B2

(12) United States Patent
Lee

(10) Patent No.: US 11,428,377 B2
(45) Date of Patent: Aug. 30, 2022

(54) LAMP MODULE FOR VEHICLE, AND LAMP FOR VEHICLE INCLUDING LAMP MODULE

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/391,077

(22) Filed: Aug. 2, 2021

(65) Prior Publication Data

US 2022/0243887 A1 Aug. 4, 2022

(30) Foreign Application Priority Data

Feb. 1, 2021 (KR) ..... 10-2021-0014246

(51) Int. Cl.
*F21S 41/24* (2018.01)
*F21S 41/143* (2018.01)
*F21S 41/148* (2018.01)

(52) U.S. Cl.
CPC ..... *F21S 41/24* (2018.01); *F21S 41/143* (2018.01); *F21S 41/148* (2018.01)

(58) Field of Classification Search
CPC ..... F21S 41/24; F21S 41/143; F21S 41/148
See application file for complete search history.

(56) References Cited

U.S. PATENT DOCUMENTS

2009/0027911 A1* 1/2009 Misawa ..... F21V 7/0091 362/545
2013/0242590 A1 9/2013 Fedosik et al.
2015/0124472 A1* 5/2015 Wintzer ..... F21S 41/24 362/522
2019/0017675 A1* 1/2019 Suwa ..... F21S 41/322

FOREIGN PATENT DOCUMENTS

JP 2018045896 A * 3/2018 ..... F21S 41/143
KR 1020200059152 A 5/2020

OTHER PUBLICATIONS

Office Action issued in corresponding Korean application No. 10-2021-0014246 dated Jun. 28, 2022.

* cited by examiner

*Primary Examiner* — Julie A Bannan
(74) *Attorney, Agent, or Firm* — NovoTechIP International PLLC

(57) ABSTRACT

According to one aspect of the present disclosure, disclosed is a lamp module for a vehicle, the lamp module including: a first light source and a second light source for forming two or more types of light distribution patterns; and a light guide unit provided on one side of the first light source and the second light source. The first light source is provided behind the light guide unit and faces a rear surface portion of the light guide unit, and the second light source is provided below the light guide unit and faces a lower surface portion of the light guide unit. The light emitted from the first light source is emitted to the outside to form a first light distri- (Continued)

bution pattern, and the light emitted from the second light source is emitted to the outside to form a second light distribution pattern.

19 Claims, 7 Drawing Sheets

LAMP MODULE FOR VEHICLE, AND LAMP FOR VEHICLE INCLUDING LAMP MODULE

CROSS-REFERENCE TO RELATED APPLICATIONS

This application claims priority from and the benefit of Korean Patent Application No. 10-2021-0014246, filed on Feb. 1, 2021, which is hereby incorporated by reference for all purposes as if set forth herein.

BACKGROUND OF THE INVENTION

1. Field of the Invention

Exemplary embodiments relate to a lamp module for a vehicle and a lamp for a vehicle including the lamp module.

2. Discussion of Related Art

Various types of lamps for a vehicle are mounted to a vehicle according to functions thereof. For example, a low beam lamp, a high beam lamp, a daytime running light (DRL) lamp, and the like are mounted to the front of the vehicle.

According to the related art, various types of lamps were mounted together to a vehicle, and thus, light emitting surfaces formed by the lamps became different from each other. Accordingly, due to this difference, the consumer's demands for design of the vehicle when the lamps are turned on have not been satisfied.

Furthermore, according to the related art, various types of lamps were mounted to the vehicle, and thus, the space occupied by the lamps in the vehicle became excessively large.

BRIEF SUMMARY OF THE INVENTION

Exemplary embodiments of the present disclosure provide a lamp for a vehicle. One lamp for a vehicle is allowed to perform two or more functions, and thus, one light emitting surface may be shared even when the lamp having different functions is turned. Therefore, differentiated design for a vehicle may be achieved.

A first exemplary embodiment of the present disclosure provides a lamp module for a vehicle, the lamp module including: a plurality of light sources configured to form two or more types of light distribution patterns; and a light guide unit provided on one side of the plurality of light sources, wherein the light sources include: a first light source provided behind the light guide unit and facing a rear surface portion of the light guide unit; and a second light source provided below the light guide unit and facing a lower surface portion of the light guide unit, wherein at least a portion of light emitted from the first light source is emitted to the outside after passing through the rear surface portion of the light guide unit, thereby forming a first light distribution pattern, and at least a portion of light emitted from the second light source is emitted to the outside after being reflected from the lower surface portion of the light guide unit, thereby forming a second light distribution pattern.

The lower surface portion of the light guide unit may include a first recessed area having an upwardly recessed shape, and the second light source may be vertically overlapped by the first recessed area.

The first recessed area may include: a first surface provided in the rear of the first recessed area; and a second surface provided in the front of the first recessed area, wherein the first surface and the second surface are in contact with each other at an upper end of the first recessed area.

The second light source may be vertically overlapped by the first surface.

When the first recessed area is cut horizontally, the first surface may have a straight line shape or a rearward recessed parabolic shape.

A reflection layer may be formed on the first surface.

The first recessed area may further include a cut-off portion which has a stepped shape and is provided at the upper end of the first recessed area where the first surface and the second surface are in contact with each other.

The rear surface portion of the light guide unit may have a curved surface shape convexly protruding toward the first light source.

A front surface portion of the light guide unit may include: a first curved area which has a curved surface shape convexly protruding outwardly; and a second curved area which is provided above the first curved area and has a curved surface shape convexly protruding outwardly.

The first curved area and the second curved area may have aspherical lens shapes with different radii of curvature.

Around an area in which the first curved area and the second curved area are in contact with each other, a radius of curvature of the second curved area may be greater than a radius of curvature of the first curved area.

The first light distribution pattern may be formed by light which, among the light emitted from the first light source, passes through the first curved area, and the second light distribution pattern may be formed by light which, among the light emitted from the second light source, passes through the second curved area.

The front surface portion of the light guide unit may further include a second recessed area which is provided below the first curved area and has an upwardly recessed shape.

The lamp module may further include: a first substrate to which the first light source is bonded; a second substrate to which the second light source is bonded; and a heat sink provided in close contact with the first substrate and the second substrate.

In the heat sink, an area to which the first substrate is bonded and an area to which the second substrate is bonded may be integrally formed.

A second exemplary embodiment of the present disclosure provides a lamp for a vehicle, including a plurality of lamp modules for a vehicle, wherein the lamp module includes: a plurality of light sources configured to form two or more types of light distribution patterns; and a light guide unit provided on one side of the plurality of light sources, wherein the light sources include: a first light source provided behind the light guide unit and facing a rear surface portion of the light guide unit; and a second light source provided below the light guide unit and facing a lower surface portion of the light guide unit, wherein at least a portion of light emitted from the first light source is emitted to the outside after passing through the rear surface portion of the light guide unit, thereby forming a first light distribution pattern, and at least a portion of light emitted from the second light source is emitted to the outside after being reflected from the lower surface portion of the light guide unit, thereby forming a second light distribution pattern.

The lamp may include: a plurality of upper lamp modules which are provided on an upper side and arranged horizontally; and a plurality of lower lamp modules which are provided below the upper lamp modules and arranged horizontally, wherein a shape of a front surface portion of the light guide unit provided in each of the upper lamp modules is different from a shape of a front surface portion of the light guide unit provided in each of the lower lamp modules.

The front surface portion of the light guide unit may include: a first curved area which has a curved surface shape convexly protruding outwardly; a second curved area which is provided above the first curved area and has a curved surface shape convexly protruding outwardly; and a second recessed area which is provided below the first curved area and has an upwardly recessed shape, wherein the second recessed area is provided only in each of the plurality of lower lamp modules.

The first light distribution pattern may be a low beam pattern, and the second light distribution pattern may be a DRL pattern.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE INVENTION

Hereinafter, a lamp module for a vehicle and a lamp for a vehicle according to the present disclosure will be described with reference to the drawings.

Lamp Module for Vehicle

Figure 1:
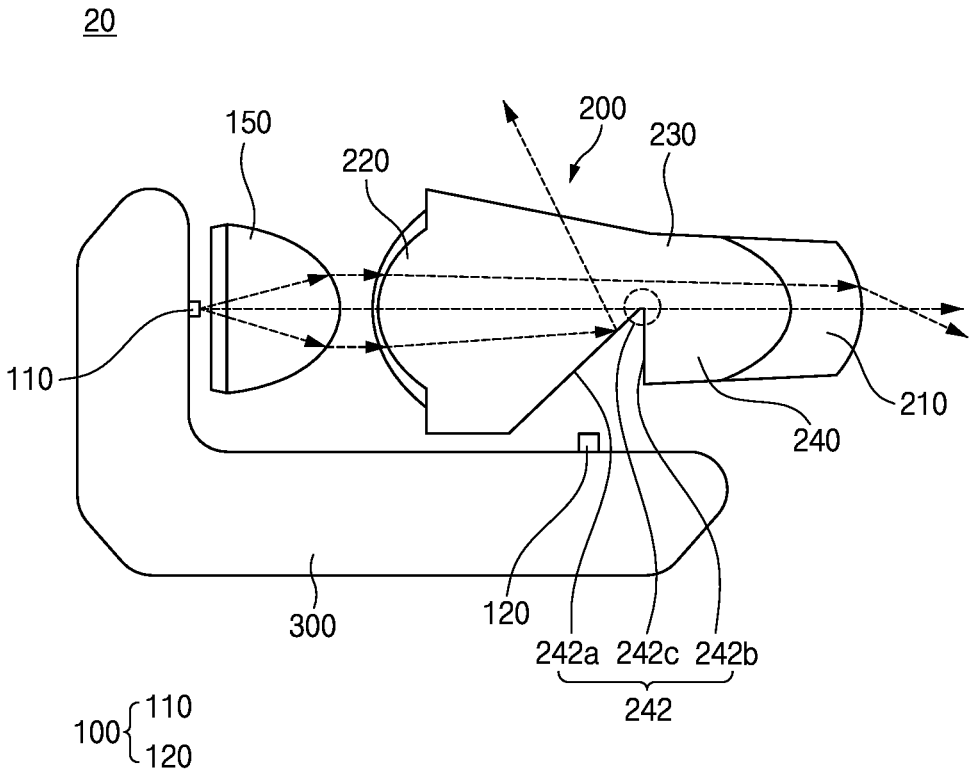
FIG. 1 is a side view illustrating a state when a first light source is turned on in a lamp module for a vehicle according to the present disclosure.
Figure 2:
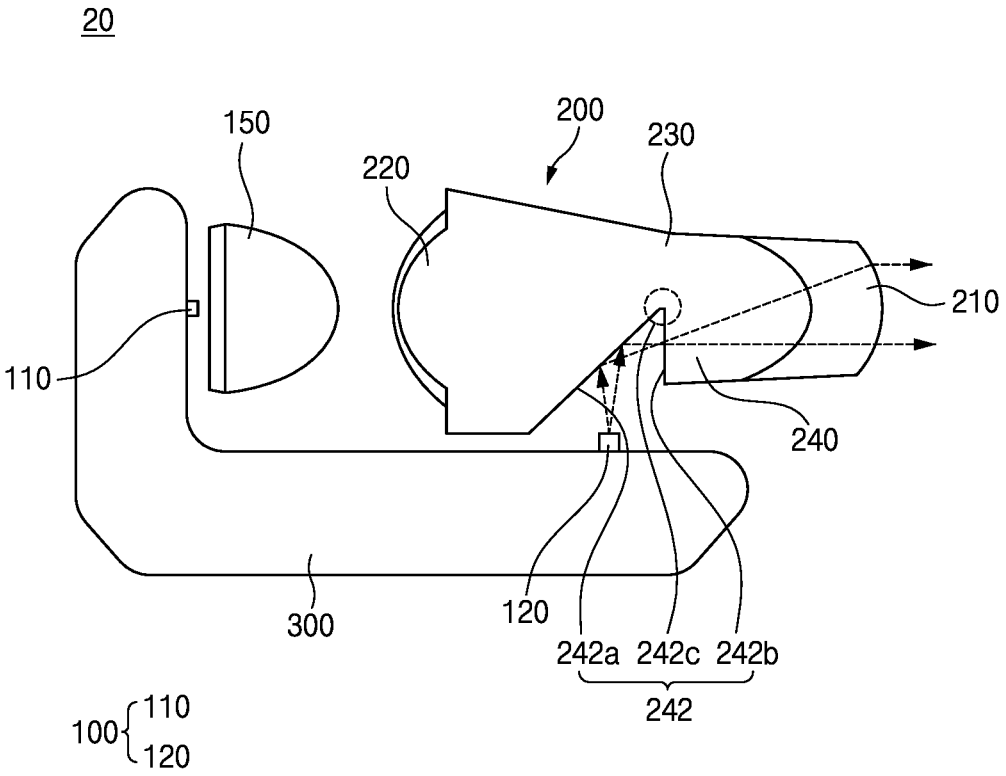
FIG. 2 is a side view illustrating a state when a second light source is turned on in a lamp module for a vehicle according to the present disclosure.

FIG. 1 is a side view illustrating a state when a first light source is turned on in a lamp module for a vehicle according to the present disclosure, and FIG. 2 is a side view illustrating a state when a second light source is turned on in a lamp module for a vehicle according to the present disclosure.

A lamp module 20 for a vehicle (hereinafter, referred to as a 'lamp module') according to the present disclosure may be a lamp module capable of forming two or more types of light distribution patterns. That is, the lamp module 20 according to the present disclosure may individually form a first light distribution pattern and a second light distribution pattern different from the first light distribution pattern. For one example, the first light distribution pattern may be a low beam pattern, and a second light distribution pattern may be a DRL pattern. However, types of the first light distribution pattern and the second light distribution pattern are not limited to those described above, and these light distribution patterns may be applied to various types of beam patterns.

The lamp module 20 according to the present disclosure may include: a plurality of light sources 100 for forming two or more types of light distribution patterns; and a light guide unit 200 provided on one side of the plurality of light sources 100 and facing the plurality of light sources 100. The light guide unit 200 may be a lens.

The light guide unit 200 may be divided into a plurality of areas according to the positions. More specifically, the light guide unit 200 may include a front surface portion 210 that forms a front area of the light guide unit, a rear surface portion 220 that forms a rear area of the light guide unit, an upper surface portion 230 that forms an upper area of the light guide unit, and a lower surface portion 240 that forms a lower area of the light guide unit.

Also, the light sources 100 may include a first light source 110 provided behind the light guide unit 200 and facing the rear surface portion 220 of the light guide unit 200; and a second light source 120 provided below the light guide unit 200 and facing the lower surface portion 240 of the light guide unit 200. For one example, the first light source 110 and the second light source 120 may be LEDs, but types of the light sources may not be limited to those described above. Meanwhile, the second light distribution pattern may be formed above the first light distribution pattern.

According to the present disclosure, at least a portion of light emitted from the first light source 110 may be emitted to the outside after passing through the rear surface portion 220 of the light guide unit 200, thereby forming the first light distribution pattern. At least a portion of light emitted from the second light source 120 may be emitted to the outside after being reflected from the lower surface portion 240 of the light guide unit 200, thereby forming the second light distribution pattern. FIG. 1 illustrates a state in which the light emitted from the first light source 110 is emitted to the front surface portion 210 after passing through the rear surface portion 220 of the light guide unit 200, thereby forming the first light distribution pattern. FIG. 2 illustrates a state in which the light emitted from the second light source 120 is emitted to the front surface portion 210 after being reflected from the lower surface portion 240 of the light guide unit 200, thereby forming the second light distribution pattern.

Meanwhile, the lamp module 20 according to the present disclosure may further include a collimator 150 provided between the first light source 110 and the light guide unit 200. The collimator 150 may be a component that converts the light emitted from the first light source 110 into parallel light and then supplies the parallel light to the light guide unit 200. On the other hand, the collimator 150 or the like is not provided between the second light source 120 and the light guide unit 200, but an empty space may be formed therebetween.

Continuing to refer to FIGS. 1 and 2, the lower surface portion 240 of the light guide unit 200 may include a first recessed area 242 having an upwardly recessed shape. Here, the second light source 120 may be vertically overlapped by the first recessed area 242.

More preferably, the first recessed area 242 may include a first surface 242*a* provided in the rear of the first recessed area 242 and a second surface 242*b* provided in the front of the first recessed area 242. The second light source 120 may be vertically overlapped by the first surface 242*a*. Thus, most of the light emitted from the second light source 120 may arrive at the first surface 242*a*.

Meanwhile, a reflection layer may be formed on the first surface 242*a*. Thus, according to the present disclosure, the light, which is emitted from the second light source 120 and arrives at the first surface 242*a*, may be reflected from the reflection layer formed on the first surface 242*a* and then move to the front surface portion 210 of the light guide unit 200. For this, the first surface 242*a* may have a shape extending diagonally from a lower rear side of the lamp module 20 toward an upper front side.

Meanwhile, the first surface 242*a* and the second surface 242*b* may be in contact with each other at an upper end of the first recessed area 242. More specifically, the first recessed area 242 may further include a cut-off portion 242*c* which has a stepped shape and is provided at the upper end of the first recessed area 242 where the first surface 242*a* and the second surface 242*b* are in contact with each other. As described above, the first light distribution pattern formed by the first light source 110 may be a low beam pattern, and the cut-off portion 242*c* may be a component for forming a cut off line that needs to be formed in an upper area of the low beam pattern according to regulations. That is, according to the present disclosure, a portion of the light emitted from the first light source 110 is blocked by the cut-off portion 242*c*, and thus, the low beam pattern having the cut off line may be formed.

Continuing to refer to FIGS. 1 and 2, when the first recessed area 242 provided in the lamp module 20 according to the present disclosure is cut horizontally, the first surface 242*a* may have a straight line shape or a rearward recessed parabolic shape. This is to secure a reflection angle at which the light, which is emitted from the second light source 120 and is reflected from the first surface 242*a*, may arrive at the front surface portion 210 of the light guide unit 200. As described above, the second light distribution pattern formed by the second light source 120 may be a DRL pattern. In a case where the above-described cross-section of the first surface 242*a* has a rearward recessed parabolic shape, when the light, which is emitted from the second light source 120 and is reflected from the first surface 242*a*, arrives at the front surface portion 210 of the light guide unit 200, the light may arrive in a focused state. Thus, the overall optical efficiency of the lamp module 20 may increase.

Meanwhile, as illustrated in FIGS. 1 and 2, the rear surface portion 220 of the light guide unit 200 may have a curved surface shape convexly protruding toward the first light source 110. Thus, the light, which is emitted from the first light source 110 and converted into parallel light through the collimator 150, may be focused while passing through the rear surface portion 220.

Figure 3:
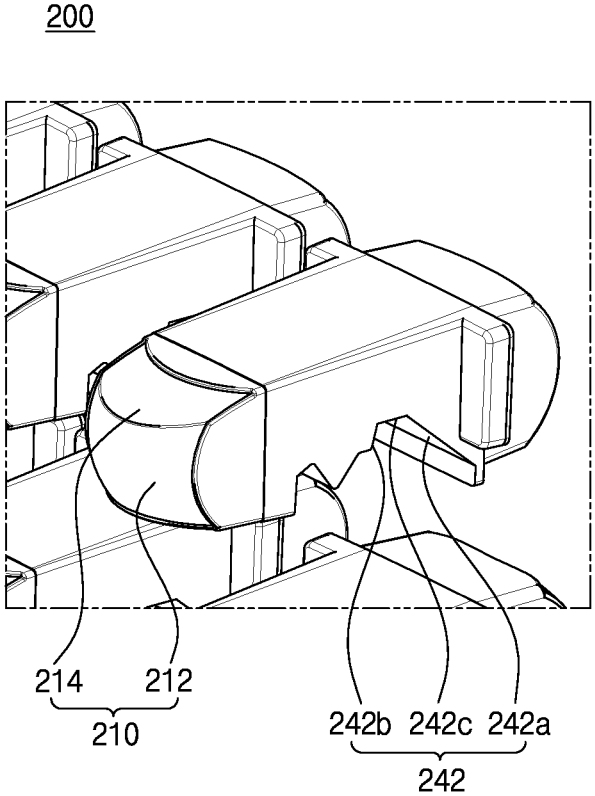
FIG. 3 is a perspective view illustrating a light guide unit provided in a lamp module for a vehicle according to an exemplary embodiment of the present disclosure.
Figure 4:
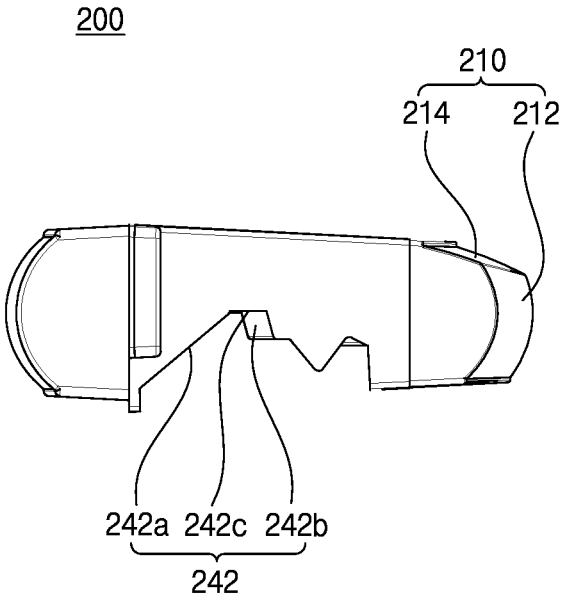
FIG. 4 is a side view illustrating a light guide unit provided in a lamp module for a vehicle according to an exemplary embodiment of the present disclosure.

FIG. 3 is a perspective view illustrating a light guide unit provided in a lamp module for a vehicle according to an exemplary embodiment of the present disclosure, and FIG. 4 is a side view illustrating a light guide unit provided in a lamp module for a vehicle according to an exemplary embodiment of the present disclosure.

According to the present disclosure, unlike the rear surface portion 220 of the light guide unit 200 having a single curved surface shape, the front surface portion 210 of the light guide unit 200 may be made of a plurality of curved surface shapes. More specifically, according to the present disclosure, the front surface portion 210 of the light guide unit 200 may include a first curved area 212 which has a curved surface shape convexly protruding outwardly and a second curved area 214 which is provided above the first curved area 212 and has a curved surface shape convexly protruding outwardly. The first curved area 212 and the second curved area 214 may have different radii of curvature.

More preferably, the first curved area 212 and the second curved area 214 may have aspherical lens shapes with different radii of curvature. The first curved area 212 is an area at which the light emitted from the first light source 110 mainly arrives, and the first light distribution pattern may be formed by the light which, among the light emitted from the first light source 110, passes through the first curved area 212. The second curved area 214 is an area at which the light emitted from the second light source 120 mainly arrives, and the second light distribution pattern may be formed by the light which, among the light emitted from the second light source 120, passes through the second curved area 214.

More specifically, around an area in which the first curved area 212 and the second curved area 214 are in contact with each other, a radius of curvature of the second curved area 214 may be greater than a radius of curvature of the first curved area 212. This may be understood as that, around an area in which the first curved area 212 and the second curved area 214 are in contact with each other, the surface of the second curved area 214 has a flat surface-like shape compared to the surface of the first curved area 212. Thus, as illustrated in FIGS. 3 and 4, a sharply protruding area may be formed in the area in which the first curved area 212 and the second curved area 214 are in contact with each other.

Figure 5:
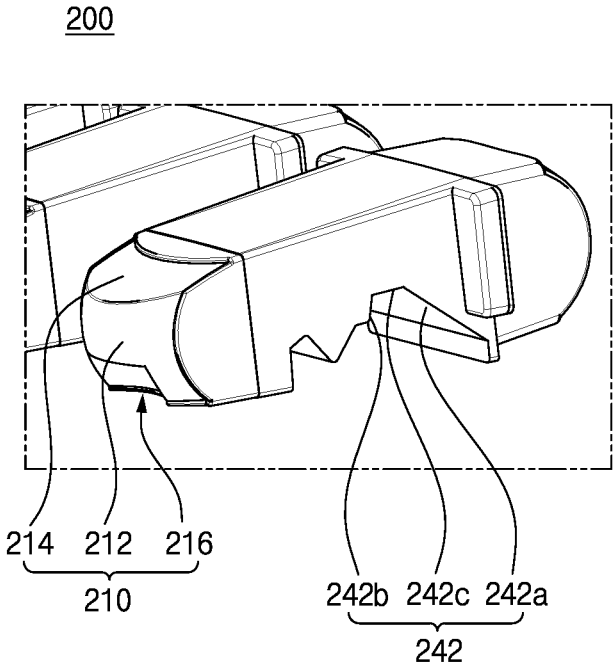
FIG. 5 is a perspective view illustrating a light guide unit provided in a lamp module for a vehicle according to another exemplary embodiment of the present disclosure.
Figure 6:
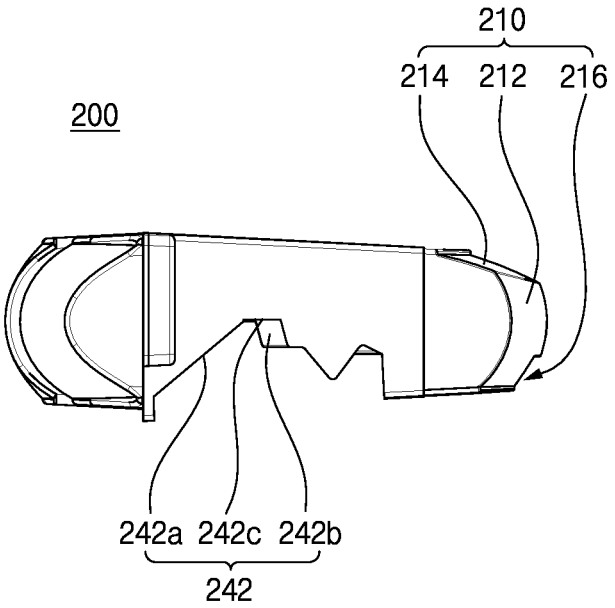
FIG. 6 is a side view illustrating a light guide unit provided in a lamp module for a vehicle according to another exemplary embodiment of the present disclosure.

FIG. 5 is a perspective view illustrating a light guide unit provided in a lamp module for a vehicle according to another exemplary embodiment of the present disclosure, and FIG. 6 is a side view illustrating a light guide unit provided in a lamp module for a vehicle according to another exemplary embodiment of the present disclosure.

According to another exemplary embodiment of the present disclosure, the front surface portion 210 of the light guide unit 200 may further include a second recessed area 216 which is provided below the first curved area 212 and has an upwardly recessed shape, in addition to the first curved area 212 and the second curved area 214. That is, according to another exemplary embodiment, an empty space may be formed in a lower area of the front surface portion 210 of the light guide unit 200 by the second recessed area 216.

The second recessed area 216 may be configured to secure a quantity of light required in the regulations so that a driver may recognize at least the presence of an object even in an upper area of a low beam pattern when the first light source 110 is turned on to form the low beam pattern. That is, according to another exemplary embodiment of the present disclosure, at least a portion of the light, which is emitted from the first light source 110 and arrives at the second recessed area 216, may arrive at an upper area of the first light distribution pattern. Meanwhile, the second recessed area 216 may be below the cut-off portion 242*c*.

Meanwhile, the lamp module 20 according to the present disclosure may further include a first substrate (not shown) to which the first light source 110 is bonded or mounted, a second substrate (not shown) to which the second light source 120 is bonded, and a heat sink 300 provided in close contact with the first substrate and the second substrate. The heat sink 300 may be a component for cooling the first light source 110 and the second light source 120. More specifically, according to the present disclosure, in the heat sink 300, an area to which the first substrate is bonded and an area to which the second substrate is bonded may be integrally formed. The heat sink 300 may not only cool the first light source 110 and the second light source 120, but also serve as a support to which the first light source 110 and the second light source 120 provided in the lamp module 20 may be fixed.

Lamp for Vehicle

Figure 7:
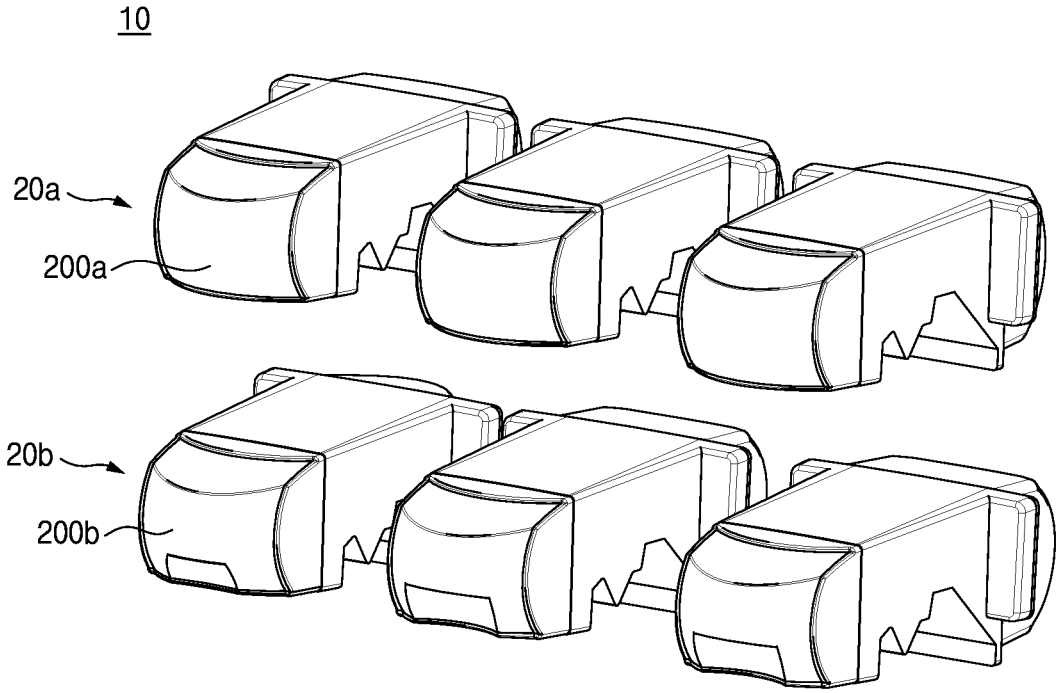
FIG. 7 is a perspective view illustrating a plurality of light guide units provided in a lamp for a vehicle according to the present disclosure.

FIG. 7 is a perspective view illustrating a plurality of light guide units provided in a lamp for a vehicle according to the present disclosure.

Referring to FIGS. 1 to 7, a lamp 10 for a vehicle (hereinafter, referred to as a 'lamp') according to the present disclosure may include a plurality of lamp modules.

Each of the lamp modules may include: a plurality of light sources 100 for forming two or more types of light distribution patterns; and a light guide unit 200 provided on one side of the plurality of light sources 100. The light sources 100 may include: a first light source 110 provided behind the light guide unit 200 and facing a rear surface portion 220 of the light guide unit 200; and a second light source 120 provided below the light guide unit 200 and facing a lower surface portion 240 of the light guide unit 200.

Also, according to the present disclosure, at least a portion of light emitted from the first light source 110 may be emitted to the outside after passing through the rear surface portion 220 of the light guide unit 200, thereby forming the first light distribution pattern. At least a portion of light emitted from the second light source 120 may be emitted to the outside after being reflected from the lower surface portion 240 of the light guide unit 200, thereby forming the second light distribution pattern.

Meanwhile, as illustrated in FIG. 7, the lamp 10 according to the present disclosure may include: a plurality of upper lamp modules 20*a* which are provided on an upper side of the lamp 10 and arranged horizontally; and a plurality of lower lamp modules 20*b* which are provided below the upper lamp modules 20*a* and arranged horizontally. FIG. 7 illustrates a state three upper lamp modules 20*a* and three lower lamp modules 20*b* are provided in an upper area and an lower area of the lamp 10, respectively.

According to the present disclosure, each of an upper light guide unit 200*a* provided in each of the upper lamp modules 20*a* and a lower light guide unit 200*b* provided in each of the lower lamp modules 20*b* may include: a first curved area 212 (see FIGS. 1 to 6) which has a curved surface shape convexly protruding outwardly; and a second curved area 214 (see FIGS. 1 to 6) which is provided above the first curved area 212 and has a curved surface shape convexly protruding outwardly.

Here, a shape of a front surface portion of the upper light guide unit 200*a* provided in the upper lamp module 20*a* may be different from a shape of a front surface portion of the lower light guide unit 200*b* provided in the lower lamp module 20*b*.

More specifically, the front surface portion of the lower light guide unit 200*b* may further include a second recessed area 216 (see FIGS. 5 to 6) which is provided below the first curved area and has an upwardly recessed shape, in addition to the first curved area and the second curved area described above. On the other hand, the second recessed area 216 may not be provided in the front surface portion of the upper light guide unit 200*a*. That is, in the lamp 10 according to the present disclosure, the second recessed area 216 may be provided only in each of the plurality of lower lamp modules 20*b*. This may be understood as that the lamp module described above according to the exemplary embodiment of the present disclosure is mounted as the upper lamp module of the lamp according to the present disclosure. Also, the lamp module described above according to another exemplary embodiment of the present disclosure is mounted as the lower lamp module of the lamp according to the present disclosure.

Meanwhile, the first light distribution pattern described above may be a low beam pattern, and the second light distribution pattern described above may be a DRL pattern.

The content described above with respect to the lamp module for a vehicle according to the present disclosure may also be applied to the lamp for a vehicle according to the present disclosure in the same manner.

According to the present disclosure, one lamp for a vehicle is allowed to perform two or more functions, and thus, one light emitting surface may be shared even when the lamp having different functions is turned. Therefore, differentiated design for a vehicle may be achieved.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp module for a vehicle, comprising:

a plurality of light sources configured to emit light; and a light guide unit provided on one side of the plurality of light sources and comprising rear and lower surface portions, wherein the plurality of light sources comprises:

a first light source positioned at a rear of the light guide unit and facing the rear surface portion of the light guide unit, the first light source configured to emit first light onto the rear surface portion of the light guide unit; and a second light source provided below the light guide unit and facing the lower surface portion of the light guide unit, the second light source configured to emit second light onto the lower surface portion of the light guide unit, wherein at least a portion of the first light emitted onto the rear surface portion of the light guide is emitted externally through the light guide unit, the externally emitted portion of the first light having a first light distribution pattern, and at least a portion of the second light emitted to the lower surface portion of the light guide unit is reflected by the lower surface portion of the light guide unit and emitted externally though the light guide unit, the externally emitted portion of the second light having a second light distribution pattern.

2. The lamp module of claim 1, wherein:

the light guide unit comprises a first recessed area formed at the lower surface portion of the light guide unit and having an upwardly recessed shape, and the first recessed area vertically overlaps the second light source.

3. The lamp module of claim 2, wherein the first recessed area comprises:

a first surface provided in a rear portion of the first recessed area; and a second surface provided in a front portion of the first recessed area and connected to the first surface at an upper end of the first recessed area.

4. The lamp module of claim 3, wherein the second light source is vertically overlapped by the first surface of the first recessed area.

5. The lamp module of claim 4, wherein, when the first recessed area is cut horizontally, the first surface has a straight line or parabolic shape.

6. The lamp module of claim 3, further comprising a reflection layer formed on the first surface.

7. The lamp module of claim 3, wherein the first recessed area further comprises a cut-off portion having a stepped shape and positioned at the upper end of the first recessed area between the first and second surfaces.

8. The lamp module of claim 1, wherein the rear surface portion of the light guide unit has a curved surface shape convexly protruding toward the first light source.

9. The lamp module of claim 1, wherein the light guide unit comprises a front surface portion comprising:

a first curved area having a curved surface shape convexly protruding outwardly; and a second curved area positioned above the first curved area and having a curved surface shape convexly protruding outwardly.

10. The lamp module of claim 9, wherein:

the first curved area has a first aspherical lens shape having a first radius of curvature, and the second curved area has a second aspherical lens shape having a second radius of curvature different from the first radius of curvature.

11. The lamp module of claim 9, wherein the second radius of curvature is greater than the first radius of curvature at a surface area of the front surface portion at which the first and second curved areas are connected to each other.

12. The lamp module of claim 9, wherein:

the portion of the light emitted from the first light source and passing through the first curved area forms the first light distribution pattern, and the portion of the light emitted from the second light source and passing through the second curved area forms the second light distribution pattern.

13. The lamp module of claim 9, wherein the front surface portion of the light guide unit further comprises a second recessed area positioned below the first curved area and has an upwardly recessed shape.

14. The lamp module of claim 1, further comprising:

a first substrate on which the first light source is mounted;

a second substrate on which the second light source is mounted; and a heat sink in contact with the first substrate and the second substrate.

15. The lamp module of claim 14, wherein the heat sink comprises:

a first area on which the first substrate is mounted; and a second area on which the second substrate is mounted, the first and second areas being formed integrally.

16. A lamp for a vehicle comprising a plurality of lamp modules including the lamp module of claim 1.

17. The lamp of claim 16, wherein:

the plurality of lamp modules comprises:

a plurality of upper lamp modules positioned on an upper side of the lamp and arranged horizontally; and a plurality of lower lamp modules positioned below the plurality of upper lamp modules and arranged horizontally, and a surface shape of a front surface portion of the light guide unit provided in each of the plurality of upper lamp modules is different from a surface shape of a front surface portion of the light guide unit provided in each of the plurality of lower lamp modules.

18. The lamp of claim 17, wherein:

the front surface portion of the light guide unit in each lamp module comprises:

a first curved area having a curved surface shape convexly protruding outwardly; and a second curved area positioned above the first curved area and having a curved surface shape convexly protruding outwardly, and the front surface portion of the light guide unit in each lower lamp module further comprises a second recessed area positioned below the first curved area and having an upwardly recessed shape.

19. The lamp of claim 16, wherein:

the first light distribution pattern comprises a low beam pattern, and the second light distribution pattern comprises a daytime running light (DRL) pattern.

* * * * *